US008567068B2

(12) United States Patent
Luxton

(10) Patent No.: US 8,567,068 B2
(45) Date of Patent: Oct. 29, 2013

(54) SAFETY RAZORS

(75) Inventor: Richard Hart Luxton, Geneva (CH)

(73) Assignee: The Gillette Company, Boston, MA (US)

( * ) Notice: Subject to any disclaimer, the term of this patent is extended or adjusted under 35 U.S.C. 154(b) by 302 days.

(21) Appl. No.: 13/411,909

(22) Filed: Mar. 5, 2012

(65) Prior Publication Data

US 2012/0159787 A1 Jun. 28, 2012

Related U.S. Application Data

(60) Continuation of application No. 12/077,646, filed on Mar. 20, 2008, now abandoned, which is a division of application No. 11/337,759, filed on Jan. 23, 2006, now abandoned, which is a continuation of application No. PCT/GB2004/003133, filed on Jul. 20, 2004.

(30) Foreign Application Priority Data

Jul. 21, 2003 (GB) ..... 0317010.7

(51) Int. Cl.
*B26B 19/00* (2006.01)
*B26B 21/00* (2006.01)

(52) U.S. Cl.
USPC ..... 30/34.1; 30/50

(58) Field of Classification Search
USPC ..... 30/34.1, 47, 50; D28/46
See application file for complete search history.

(56) References Cited

U.S. PATENT DOCUMENTS

| | | | | | |
|---|---|---|---|---|---|
| 840,244 | A | * | 1/1907 | Odell et al. | 30/50 |
| 1,272,816 | A | * | 7/1918 | Leslie | 30/50 |
| 1,633,139 | A | * | 6/1927 | Staats-Oels | 30/50 |
| 1,920,711 | A | * | 8/1933 | Pelizzola | 30/50 |
| 2,048,565 | A | | 7/1936 | Rodrigues | |
| 2,151,265 | A | * | 3/1939 | Clausen | 30/50 |
| 2,439,909 | A | | 4/1948 | Ruskin | |
| 2,817,146 | A | * | 12/1957 | Roberts | 30/50 |
| 3,138,865 | A | | 6/1964 | Meyer | |
| 3,488,764 | A | * | 1/1970 | Welsh | 30/50 |
| 3,785,051 | A | * | 1/1974 | Dawidowicz et al. | 30/40.2 |
| 3,786,563 | A | | 1/1974 | Dorion, Jr. et al. | |
| 3,832,774 | A | | 9/1974 | Perry | |

(Continued)

FOREIGN PATENT DOCUMENTS

| | | |
|---|---|---|
| DE | 37 33 486 | 4/1989 |
| GB | 1 160 543 | 8/1969 |

(Continued)

*Primary Examiner* — Jason Daniel Prone
(74) *Attorney, Agent, or Firm* — John M. Lipchitz; Kevin C. Johnson; Steven W. Miller

(57) ABSTRACT

A safety razor blade unit has an upper face, a bottom face, a front and a rear face. A plurality of cutting edges are positioned between a first guard surface and a first cap surface at the upper face. A frame element is formed separately from and connected to the rear face, the frame element has a second guard surface and a second cap surface. An auxiliary blade is supported by the frame element having an elongated cutting edge disposed between the second guard surface and the second cap surface. The elongated cutting edge of the auxiliary blade is directed generally away from the upper face of the blade unit. The second guard surface, the second cap surface, and the cutting edge of the auxiliary blade are at the rear face of the blade unit.

7 Claims, 8 Drawing Sheets

(56) References Cited

U.S. PATENT DOCUMENTS

| | | | | | |
|---|---|---|---|---|---|
| 3,934,338 | A | * | 1/1976 | Braginetz | 30/50 |
| 4,077,119 | A | | 3/1978 | Sellera | |
| 4,170,821 | A | | 10/1979 | Booth | |
| 4,265,015 | A | | 5/1981 | Asano | |
| 4,285,124 | A | * | 8/1981 | Diakonov | 30/34.1 |
| 4,461,078 | A | * | 7/1984 | Carreker | 30/47 |
| 4,501,066 | A | * | 2/1985 | Sceberras | 30/50 |
| 4,534,110 | A | * | 8/1985 | Glass | 30/50 |
| 4,586,255 | A | | 5/1986 | Jacobson | |
| 4,663,843 | A | * | 5/1987 | Savage | 30/50 |
| 4,854,042 | A | * | 8/1989 | Byrne | 30/34.1 |
| 4,901,437 | A | | 2/1990 | Iten | |
| 4,914,817 | A | | 4/1990 | Galligan et al. | |
| 4,980,974 | A | * | 1/1991 | Radcliffe | 30/50 |
| 4,989,328 | A | * | 2/1991 | Sokoloff | 30/34.1 |
| 4,993,153 | A | * | 2/1991 | Henry | 30/50 |
| 5,036,587 | A | * | 8/1991 | Trotta et al. | 30/84 |
| 5,067,238 | A | | 11/1991 | Miller et al. | |
| 5,133,131 | A | * | 7/1992 | Hoffman | 30/50 |
| 5,199,173 | A | | 4/1993 | Hegemann et al. | |
| 5,236,439 | A | | 8/1993 | Kozikowski | |
| D343,922 | S | * | 2/1994 | Ahlgren | D28/46 |
| 5,307,564 | A | * | 5/1994 | Schoenberg | 30/50 |
| 5,343,622 | A | * | 9/1994 | Andrews | 30/50 |
| 5,542,178 | A | * | 8/1996 | Harkleroad | 30/34.1 |
| 5,575,068 | A | * | 11/1996 | Pedersen | 30/47 |
| 5,778,535 | A | * | 7/1998 | Ledesma | 30/50 |
| 5,784,790 | A | * | 7/1998 | Carson et al. | 30/532 |
| 5,794,354 | A | | 8/1998 | Gilder | |
| D423,143 | S | * | 4/2000 | Cowell | D28/46 |
| 6,044,542 | A | | 4/2000 | Apprille et al. | |
| 6,052,905 | A | * | 4/2000 | Branchinelli et al. | 30/50 |
| 6,161,288 | A | | 12/2000 | Andrews | |
| 6,276,061 | B1 | | 8/2001 | Rozenkranc | |
| 6,378,211 | B1 | | 4/2002 | McCool et al. | |
| 6,418,623 | B1 | * | 7/2002 | Marcarelli | 30/50 |
| 6,499,218 | B2 | | 12/2002 | Rocha | |
| 6,526,660 | B1 | | 3/2003 | McNeil | |
| 6,550,148 | B2 | * | 4/2003 | Cecil | 30/50 |
| 6,560,876 | B2 | * | 5/2003 | Carr | 30/50 |
| 6,568,084 | B2 | | 5/2003 | McCool et al. | |
| 6,928,738 | B2 | * | 8/2005 | Segrea | 30/34.1 |
| 7,086,160 | B2 | * | 8/2006 | Coffin et al. | 30/50 |
| 7,322,109 | B2 | * | 1/2008 | Newkirk et al. | 30/50 |
| 7,617,607 | B2 | * | 11/2009 | Pennell et al. | 30/34.1 |
| 7,761,999 | B2 | * | 7/2010 | Macove | 30/34.1 |
| 8,261,451 | B2 | * | 9/2012 | Macove | 30/34.1 |
| 2002/0050065 | A1 | * | 5/2002 | Kludjian et al. | 30/50 |
| 2003/0182802 | A1 | * | 10/2003 | Vega et al. | 30/50 |
| 2004/0055156 | A1 | | 3/2004 | Brown, Jr. | |
| 2005/0022386 | A1 | * | 2/2005 | Macove | 30/50 |
| 2005/0198825 | A1 | * | 9/2005 | Apprille | 30/40.2 |
| 2005/0198828 | A1 | * | 9/2005 | Pennell et al. | 30/50 |
| 2005/0198829 | A1 | * | 9/2005 | Gray et al. | 30/50 |
| 2005/0198830 | A1 | * | 9/2005 | Walker et al. | 30/50 |
| 2005/0198837 | A1 | * | 9/2005 | Rawle | 30/50 |
| 2005/0198839 | A1 | * | 9/2005 | Walker | 30/50 |
| 2005/0198840 | A1 | * | 9/2005 | Worrick et al. | 30/50 |
| 2005/0198841 | A1 | * | 9/2005 | Worrick, III | 30/50 |
| 2005/0198842 | A1 | * | 9/2005 | Walker et al. | 30/527 |
| 2006/0196054 | A1 | * | 9/2006 | Luxton | 30/50 |
| 2007/0214647 | A1 | * | 9/2007 | Psimadas et al. | 30/50 |
| 2007/0283567 | A1 | * | 12/2007 | Magli | 30/50 |
| 2008/0172878 | A1 | * | 7/2008 | Luxton | 30/34.1 |
| 2009/0255124 | A1 | * | 10/2009 | Hasbani | 30/50 |
| 2011/0197446 | A1 | * | 8/2011 | Macove | 30/50 |
| 2012/0325236 | A1 | * | 12/2012 | Macove | 30/50 |

FOREIGN PATENT DOCUMENTS

| | | | | |
|---|---|---|---|---|
| GB | 1591095 | | | 6/1981 |
| GB | 2 179 286 | | | 3/1987 |
| JP | 7-506503 | | | 7/1995 |
| WO | WO 91/01204 | | | 2/1991 |
| WO | WO 97/37818 | | | 10/1997 |
| WO | WO 97/37819 | | | 10/1997 |
| WO | WO 2005011930 | A1 | * | 2/2005 |

* cited by examiner

SAFETY RAZORS

CROSS REFERENCE TO RELATED APPLICATIONS

This application is a continuation of pending U.S. application Ser. No. 12/077,646, filed on Mar. 20, 2008, which is a division of application Ser. No. 11/337,759 filed Jan. 23, 2006, now abandoned, which is a continuation of application No. PCT/GB2004/003133, filed on Jul. 20, 2004, now abandoned, which claims priority to foreign application GB0317010.7, filed on Jul. 21, 2003.

FIELD OF THE INVENTION

This invention is concerned with safety razors and more particularly relates to a safety razor blade unit including at least one blade with a sharp cutting edge which is moved across the surface of the skin being shaved by means of a handle on which the blade unit is carried. The blade unit may be mounted detachably on the handle to enable the blade unit to be replaced by a fresh blade unit when the blade sharpness has diminished to an unsatisfactory level. Alternatively, the blade unit can be fixedly attached to the handle with the intention that the entire razor be discarded when the blade or blades have become dulled. Detachable and replaceable blade units are commonly referred to as shaving cartridges.

BACKGROUND OF THE INVENTION

In recent years there have been marketed blade units including a plurality of blades, in particular having two, and more recently three, blades arranged with their cutting edges extending parallel to each other for contacting the skin between guard and cap surfaces also provided by the blade unit. The performances of these blade units is enhanced by certain guard and cap structures, such as an elastomeric strip on the guard with a series of upstanding fins and a shaving aid strip included in the cap for depositing a substance, e.g. a lubricant, on the skin surface during shaving. For the most part these known blade units produce very satisfactory results. However, due to the presence of more than one blade and the particular guard and cap structure, the blade units generally contact the skin over a relatively large area and some shavers experience difficulties in shaving areas in tight corners where access by the razor is restricted by facial features such as under the nose and near the ears.

With a view to enabling the blade unit to follow the skin contours in the performance of a shaving stroke, it is well known to mount the blade unit for pivotal movement about an axis which extends parallel to the cutting edges of the blades. On the whole the pivotal movement of the blade unit relative to the handle facilitates the use of the razor by making the shaving efficiency less sensitive to small changes in handle orientation with respect to the skin as the blade unit performs a shaving stroke. It has been found that some shavers can experience difficulty, due to pivoting of the blade unit, in obtaining an optimum positioning of the blade unit against the skin when attempting to shave areas in tight corners. Also, there is a tendency for users of safety razors to wish to press the blade unit of a razor harder against the skin when trimming longer hairs, for example the sideburns, and the pivotal movement of the blade unit can sometimes be perceived to act to thwart such attempts to increase the force with which the blade cutting edges are urged against the skin.

In view of the foregoing considerations there is a need for a safety razor blade unit which is better able to satisfy the requirements of all consumers with respect to trimming longer hairs and shaving skin areas to which razor access is restricted.

There have been proposals to provide safety razors which provide increased versatility as to the manner in which they may be used for shaving. In U.S. Pat. No. 5,199,173 for example there is described a safety razor with an arched blade unit with blades providing cutting edges at both the concave and convex sides, the blade unit being selectively rotatable on the razor handle to bring the concave or convex side into an operative shaving position. GB-A-2179286 proposes a razor with two blade units pivotally mounted on a handle independently of each other and positioned on the handle to facilitate shaving the left and right sides of the face. U.S. Pat. No. 2,439,909 describes a safety razor that, rather than having blades with rectilinear cutting edges, has fixedly mounted on the razor handle a curved foil with slots that are inclined to the shaving direction in which the foil is moved across the skin during shaving and have sharpened cutting edges, there being in addition a further slot with a sharp cutting edge extending laterally across the foil behind the inclined slots, and this cutting edge associated with the additional slot being intended for hair trimming purposes. WO-A-91/01204 also describes a razor having a blade unit equipped foil blade provided with sharp-edged apertures for shaving, the blade unit being held stationary relative to the razor handle during normal shaving, but being pivotally adjustable to expose a sharp cutting edge at the leading edge of the foil for hair trimming purposes. None of the prior art proposals are suitable for adoption in the known multi-bladed safety razor blade units intended to perform pivotal movements during shaving, with a view to improving the ability of such blade units to shave areas to which access is restricted and/or to trim longer hairs.

There is described in U.S. Pat. No. 6,276,061 a safety razor blade unit having three blades with cutting edges disposed between guard and cap surfaces at a top face of the blade unit, and a further trimming blade is located at the rear face at an angle of 60-120°, particularly 85-95°, to the angle of the other three blades. The blade unit has no apparent skin contact surfaces associated with the trimming blade to control the engagement of this blade with the skin, and soap and shaving debris collecting under the trimming blade can not easily be rinsed away.

SUMMARY OF THE INVENTION

The present invention addresses the shortcomings of the prior art and provided in accordance with the invention is a safety razor blade unit comprising an upper face, a bottom face and front and rear faces, a plurality of cutting edges positioned between first guard and cap surfaces at the upper face, and a further cutting edge positioned between second guard and cap surfaces at the rear face, the distance between the first guard and cap surfaces, measured in a plane tangential thereto, being greater than that between the second guard and cap surfaces, wherein a passage for through flow of rinsing water connects a gap between the further cutting edge and the second guard surface with an opening at the bottom face.

With such a blade unit the skin contact area spanned by the guard, blades, and cap at the upper face can be relatively large and similar to the corresponding area of known multi-bladed shaving cartridges currently marketed, whereas the skin contact area spanned by an auxiliary guard, blade and cap at the rear face is substantially smaller but nonetheless enables safe use of the blade unit for shaving skin areas constricted by protruding facial features adjacent thereto. The passage for through flow of rinsing water allows effective removal of soap and shaving debris from the underside of the blade so that the performance of this blade will not be impaired by a space on the underside of the blade clogging up. Furthermore because this passage opens at the bottom face, shaving debris will be directed away from the upper face so that cut hairs will not become stuck to and contaminate the skin contact surfaces at this face, such as the surface of a lubricating strip forming the first cap surface.

The opening at the bottom face is preferably a slot which extends substantially the full length of the further cutting edge, and a lower edge of the opening is conveniently formed by a lip that extends from a guard bar on which the second guard surface is provided in a direction away from the second guard surface.

For convenience of manufacture the second guard and cap surfaces are defined by a unitary frame element. In particular the first guard and cap surfaces are provided on a main frame, and the frame element is secured to the main frame, e.g. by a snap-fit connection therewith or by means of clips which are located at the ends of the main frame. Alternatively the frame element can be moulded in situ on the main frame. The frame element and blade forming the further cutting edge can be secured to the main frame as a preassembled unit, or the frame element may serve to retain the blade on the main frame. The frame element can be formed as a plastic moulding, for example with the ends of the blade embedded therein. The second guard and cap surfaces can be connected by one or more ribs for skin control purposes and/or to reinforce the structure of the frame element. Alternative skin control formations are also possible such as a comb-like blade support defining projections extending towards the second guard surface from the underside of the further blade, or other suitable formations on the second guard surface. The distance between the second guard and cap surfaces is preferably not greater than 75% of the distance between the first guard and cap surfaces, and more especially less than 50%, e.g. 25% to 40% of the latter distance. Furthermore the width of the skin contact area of the second guard surface is preferably less than that of the first guard surface, and the width of the second cap surface is preferably less than that of the first cap surface.

The safety razor blade unit may be mounted or mountable on a supporting structure for pivotal movement about an axis extending longitudinally of the blade unit, and comprise a stop for abutment with the supporting structure to limit pivotal movement of the blade unit at an end position, shaving forces exerted on the cutting edges at the upper face during shaving acting to pivot the blade unit away from the end position, and shaving forces exerted on the further cutting edge during a shaving stroke acting to pivot the blade unit in the direction to engage the stop in abutment with the supporting structure.

In a especially convenient embodiment, the end pivotal position of the blade unit is a rest position into which the blade unit is biased by a spring structure. When shaving with the further blade located between the second guard and cap surfaces, there is no pivoting of the blade unit and the forces exerted on the blade unit press the stop into firm abutment with the supporting structure. With this arrangement the user is able to apply the cutting edge of the further blade against the skin as strongly as desired in performing hair trimming duties with the razor.

The first and second guard and cap surfaces are preferably disposed so that the plane tangential to the first guard and cap surfaces defines an angle in the range of 10° to 135° to the plane tangential to the second guard and cap surfaces. The angle between the tangential planes ensures that the blade edge or edges at the rear face are held safely clear of the skin surface when shaving with the blade edges at the upper face of the blade unit and vice versa. When the blade unit is adapted to pivot as described above, in order to ensure that the load forces with which the blade unit is applied against the skin are directed to urge the stop into firm abutment with the support structure, thereby anchoring the blade unit in the end position, the angle between the tangential planes is preferably not greater than 90° and more specifically in the range of 30° to 60°.

Whereas there are preferably three or more blades with cutting edges positioned between the first guard and cap surfaces, a single further blade with a cutting edge between the second guard and cap surfaces is preferred although more than one further blade could be provided if desired.

At least the first guard preferably includes an elastomeric strip with upwardly directed projections, such as a series of fins or tubes, as known per se, for contact with the skin Also, at least the first cap preferably includes a lubricating strip, also as known per se. The lubricating strip can be shaped and positioned so that it can contact and lubricate a skin surface in contact with the second cap and guard surfaces.

DESCRIPTION OF THE DRAWINGS

Some preferred forms of blade unit embodying the invention are described in greater detail below with reference being made to the accompanying drawings in which.

DESCRIPTION OF THE PREFERRED EMBODIMENTS

Figure 1:
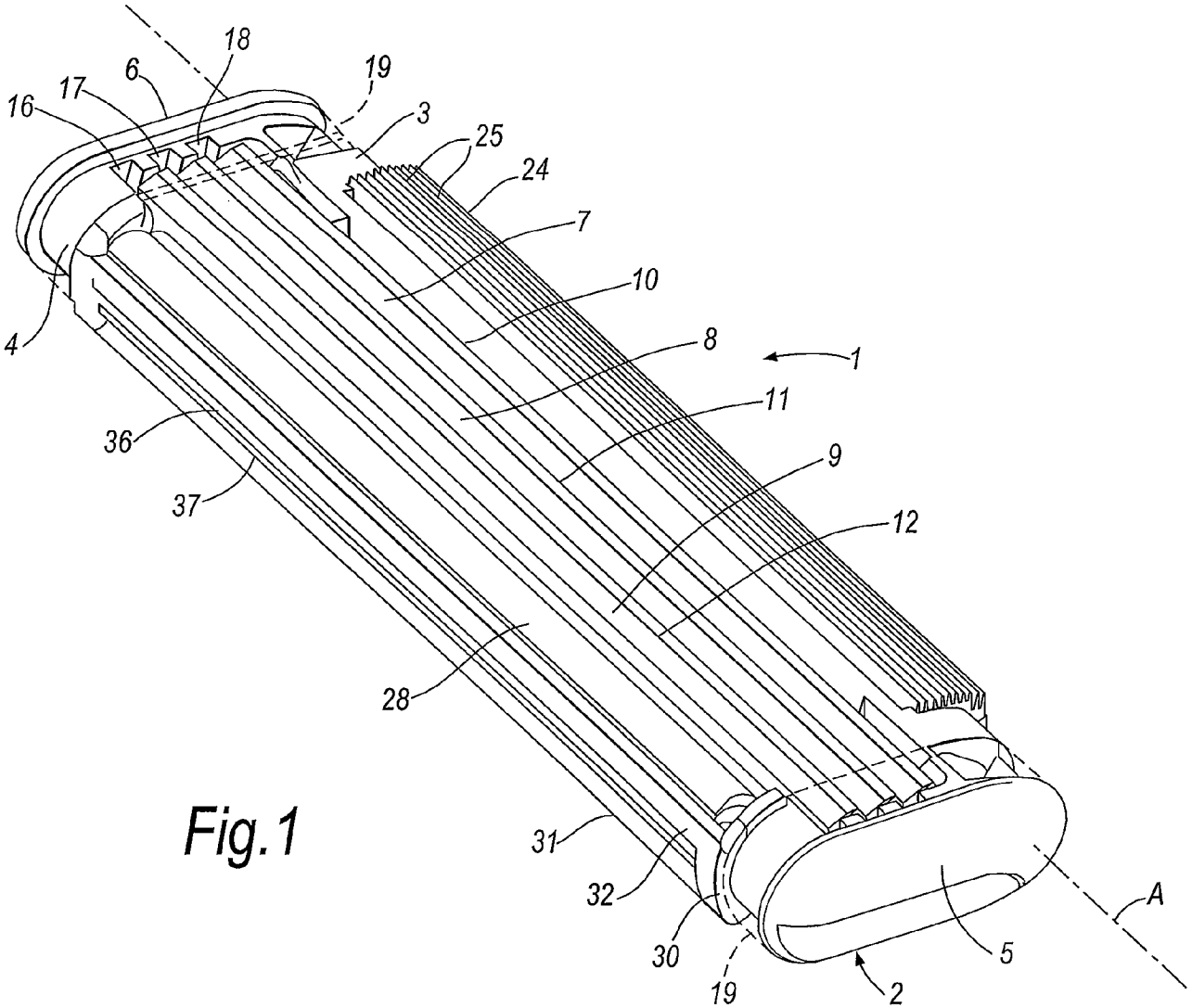
FIG. 1 is an isometric view of the blade unit shown from the rear.
Figure 2:
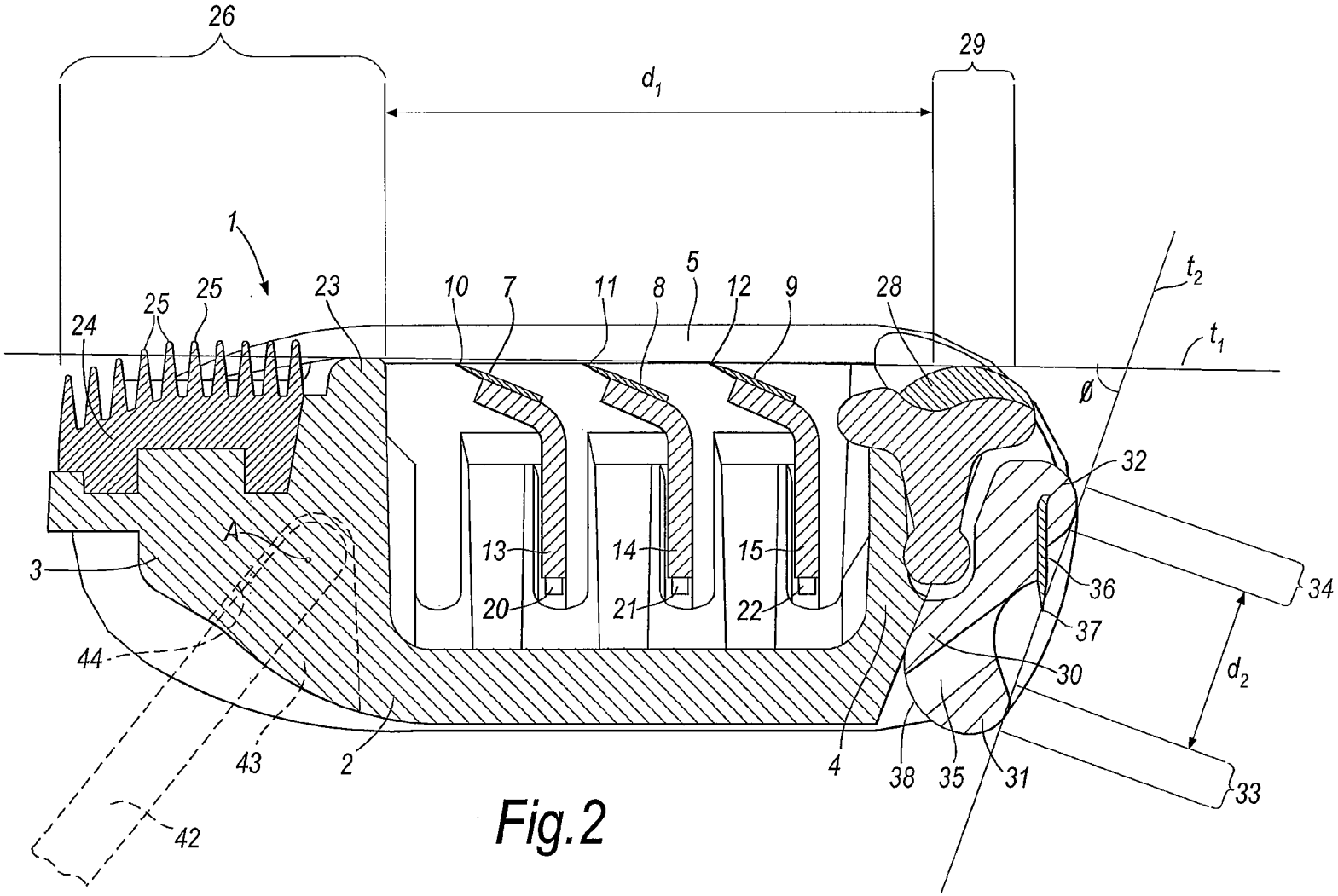
FIG. 2 is a cross-section through the blade unit of FIG. 1.
Figure 3:
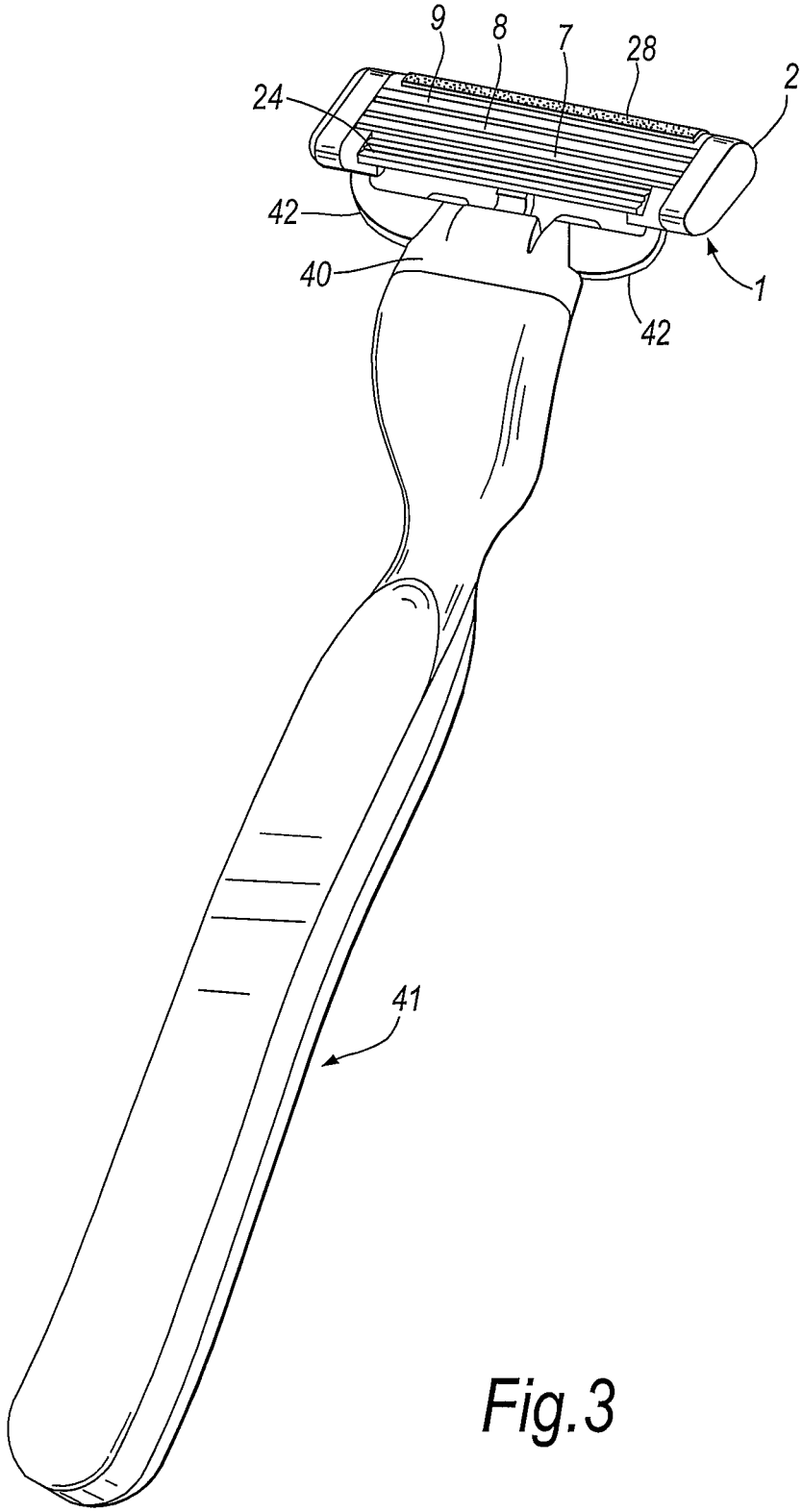
FIG. 3 shows the blade unit mounted on a handle.

There is illustrated in FIGS. 1 and 2 a safety razor blade unit 1 comprising a plastic housing or main frame 2 including front and rear members 3, 4 interconnected by integral frame ends 5, 6. Mounted in the main frame between the front and rear members 3, 4 are three blades 7, 8, 9 with parallel forwardly facing sharp cutting edges 10, 11, 12 positioned at an upper face of the blade unit. The blades are carried by elongate blade supports 13, 14, 15 the ends of which are guided in slots 16, 17, 18 in the frame ends. In a manner known per se the blades 7, 8, 9 are capable of moving independently of each other under forces imposed on the respective blades during shaving. The blades are retained in the slots by metal clips 19 which are wrapped around the ends of the main frame. Springs 20, 21, 22 act on the undersides of the blade supports 13, 14, 15 and provide return forces opposing downward displacements of the blades 7, 8, 9. The front frame member 3 defines a backstop 23 with an upper surface for contact with the skin during shaving, and carries an elastomeric guard strip 24 shown to have a series of parallel upstanding fins 25 also for contact with the skin during shaving. Other elastomeric strip surface configurations could be provided in addition to or instead of the fins 25. The elastomeric strip 24 and backstop 23 together define a first guard surface 26 for contact with the skin The frame member 3 also defines the front face of the blade unit. The rear frame member 4 carries on its upper side a lubricating strip 28 which defines a first cap surface 29 for contacting the skin behind the blades 7, 8, 9 when shaving the skin with these blades. Thus, the first guard surface 26, the cutting edges 10, 11, 12 of the blades 7, 8, 9 and the first cap surface 29 lie at an upper face of the blade unit. Attached securely to the rear frame member 4 behind the lubricating strip 28 is a frame element 30 which may be a plastics moulding either formed separately and connected to the rear frame member 4, such as by a snap connection, or moulded in situ. The frame element 30 includes spaced parallel bars 31, 32 which respectively define a second guard surface 33 and a second cap surface 34. Supported firmly by the frame element 30 is an auxiliary further blade 36 having an elongate sharp cutting edge 37 disposed between the second guard and cap surfaces 33, 34 and directed generally away from the upper face of the blade unit, the second guard and cap surfaces 33, 34 and the cutting edge 37 of the further blade 36 lying at a rear face of the blade unit. The width of the area of the second guard surface 33 which contacts the skin when shaving with the further blade 36 is substantially narrower than the width of the area of first guard surface 26 which contacts the skin when shaving with the blades 7, 8, 9. Similarly the width of the skin contact area of the second cap surface 34 is narrower than that of the first cap surface 29. Furthermore, as can be readily seen in FIG. 2, the distance $d_1$ between the first guard and cap surfaces, 26, 29 measured in the plane $t_1$ tangential to these surfaces is substantially greater, in particular about 3 to 4 times greater, than the distance $d_2$ between the second guard and cap surfaces 33, 34 measured in the plane $t_2$ tangential to these surfaces. As a result the blade unit 1 contacts the skin over a much smaller area when shaving with the further blade 36 at the rear face of the blade unit than it does when shaving with the blades 7, 8, 9 at the upper face, and the rear face of the blade unit can be used to shave easily areas where access is restricted by adjacent facial features such as directly under the nostrils. The tangential plane $t_2$ is at an angle of about 45° to the tangential plane $t_1$, the significance of which will become clear.

A passage for through flow of rinsing water if formed by a slot 35 that extends along the frame element 30 and this slot 35 connects the gap defined between the second guard surface and the cutting edge 37 of the blade 36 with an opening 38 at the bottom face of the blade unit. The rinsing passage defined by the slot 35 facilitates removal of soap and shaving debris which tends to collect under the blade 36 during shaving and avoids the shaving performance of this blade becoming impaired due to the space under the blade clogging up.

Figure 4:
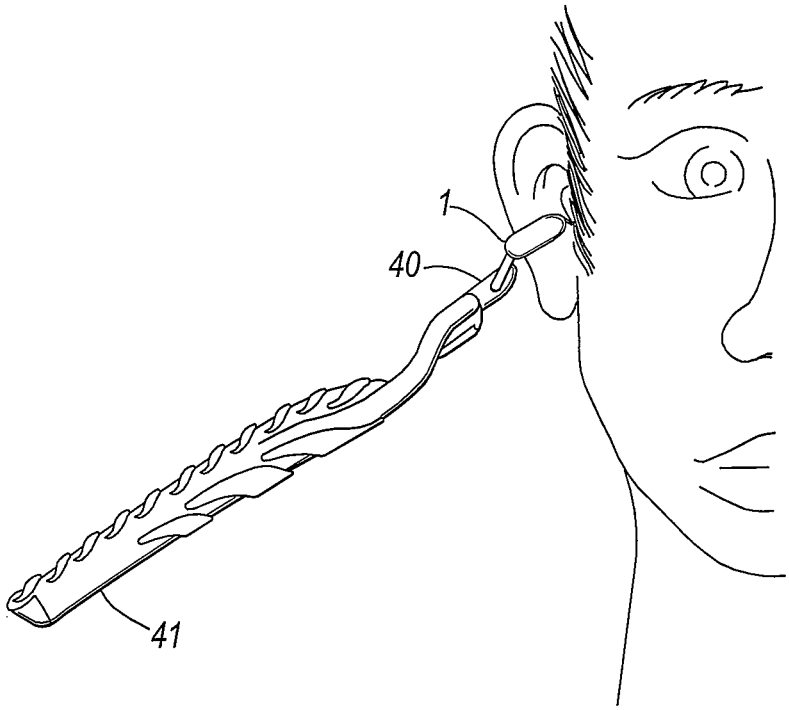
FIG. 4 is a sketch illustrating a razor equipped with the blade unit in a position for trimming hair in front of an ear of the razor user.
Figure 5:
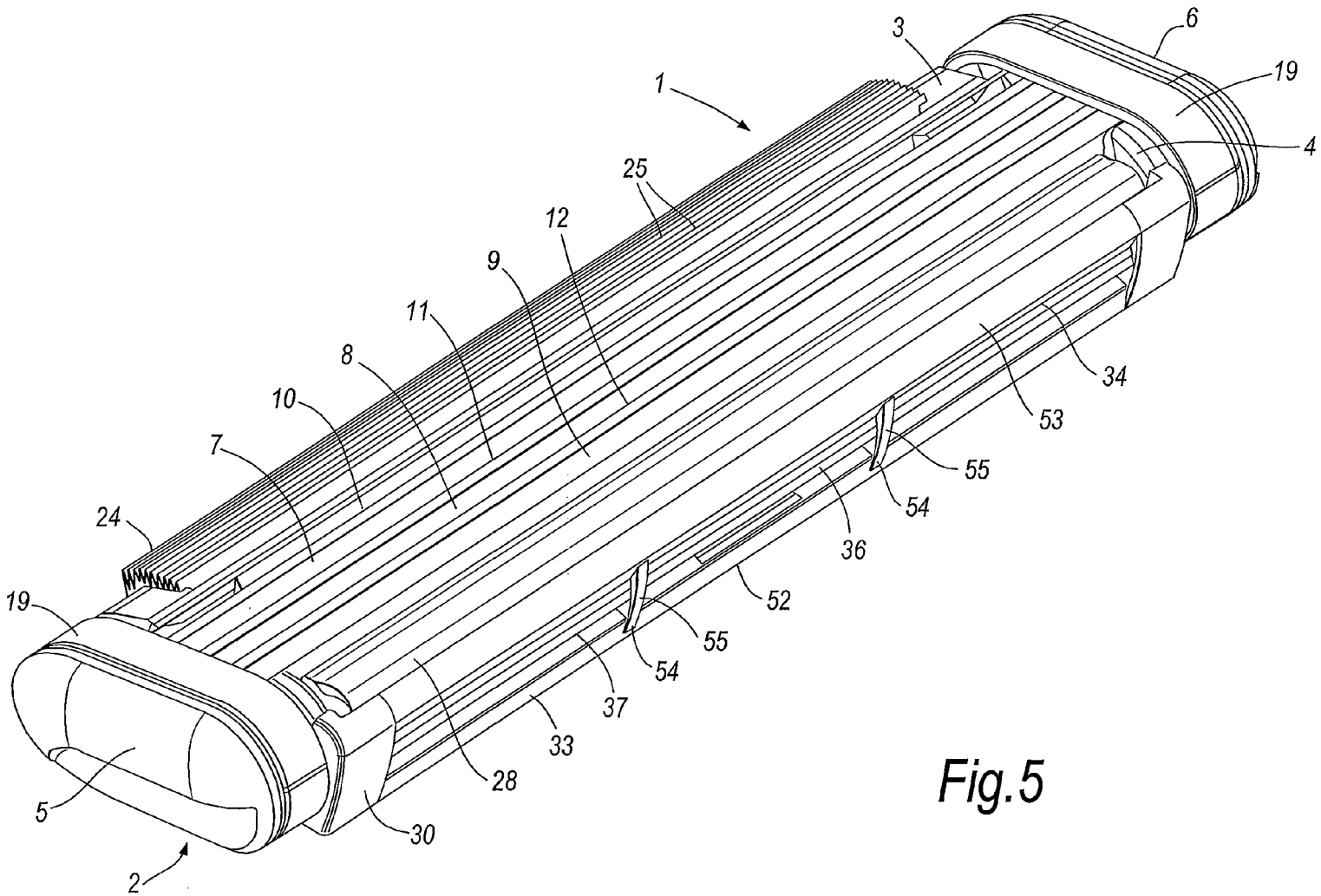
FIG. 5 is a isometric view showing another blade unit from the rear.
Figure 6:
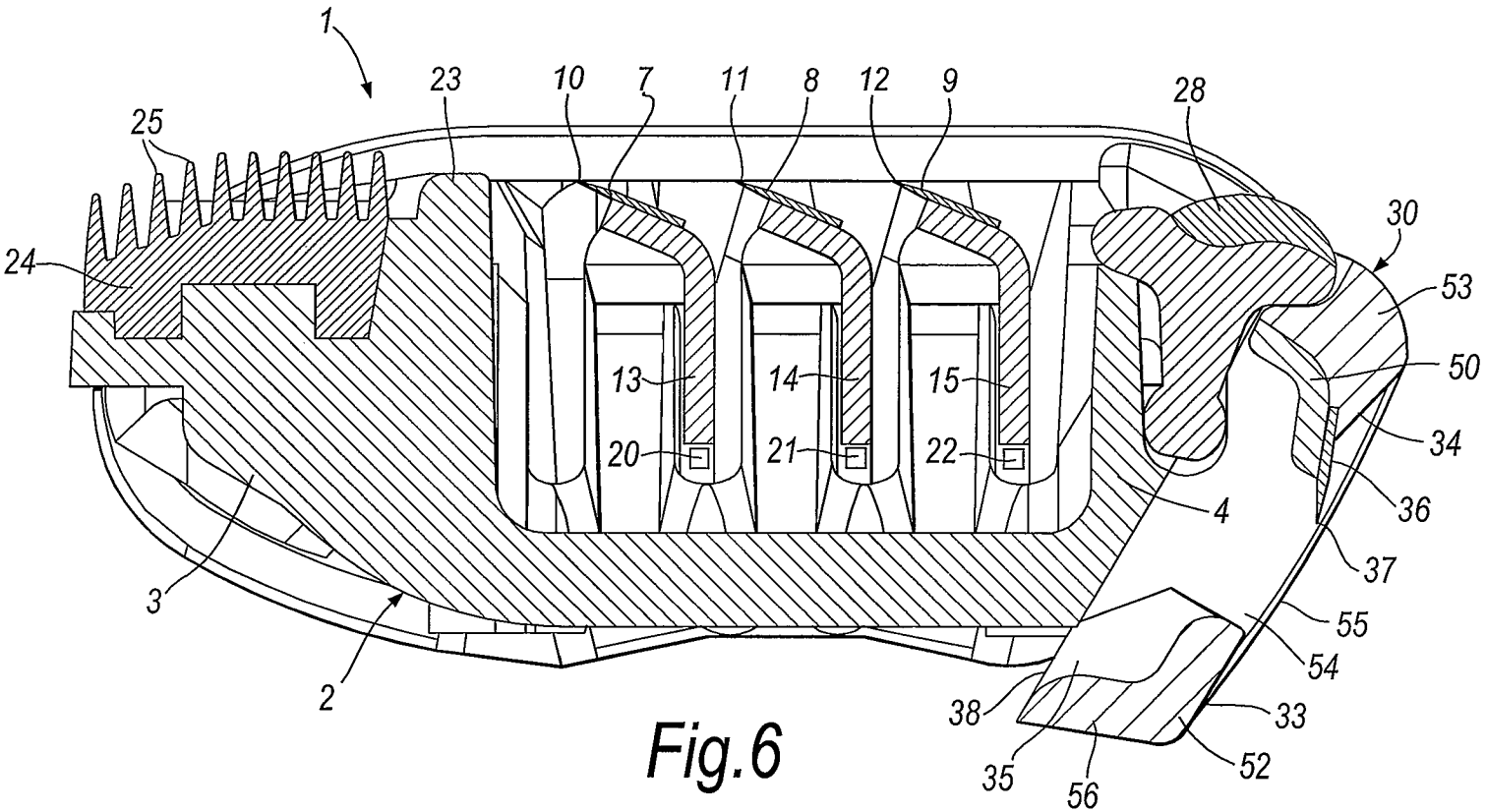
FIG. 6 is a cross-section through the blade unit of FIG. 5.
Figure 7:
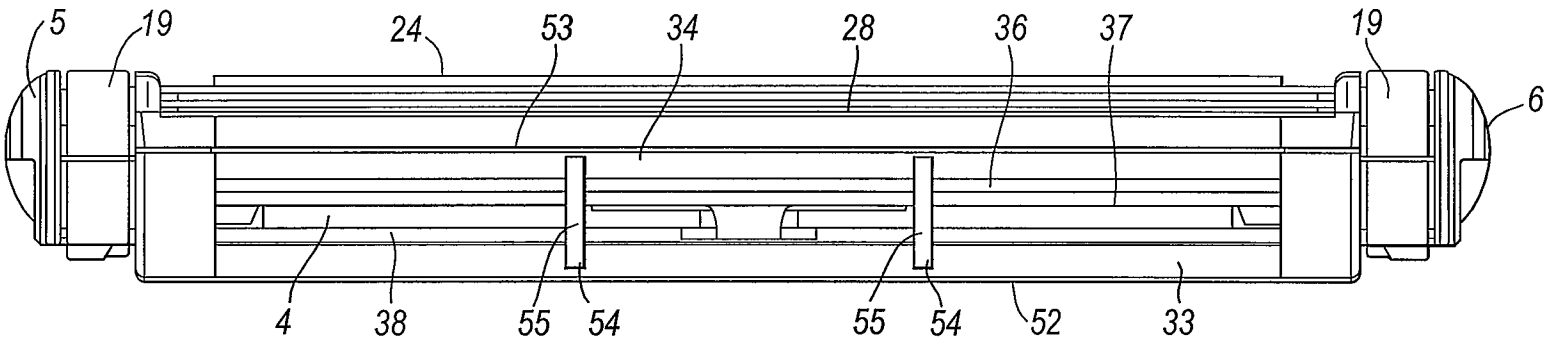
FIG. 7 shows the blade unit of FIG. 5 from the rear.
Figure 8:
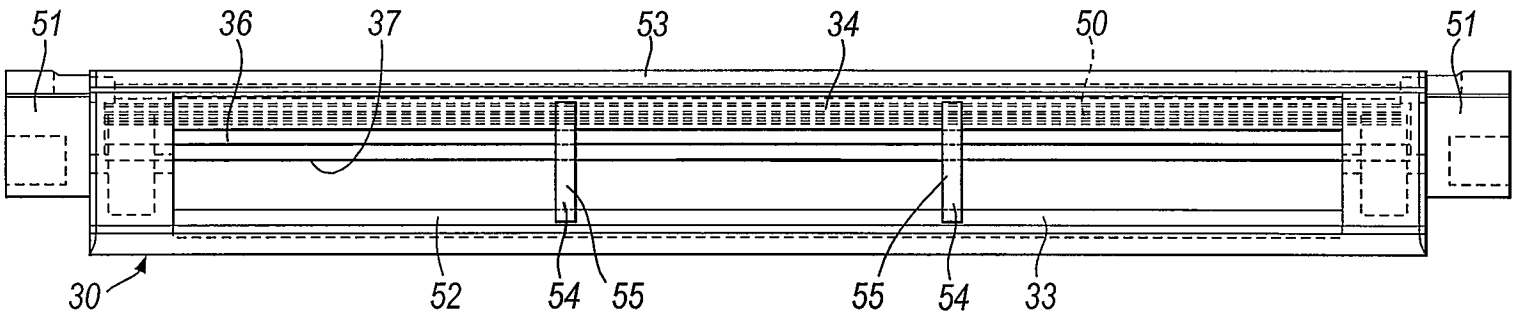
FIG. 8 is a rear view of the frame element and auxiliary blade sub-assembly.
Figure 9:
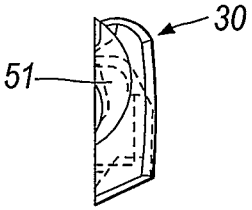
FIG. 9 is an end view of the frame element.

The blade unit 1 is adapted to be mounted pivotally on a support structure 40 connected to a handle 41 so the blade unit can pivot about an axis A parallel with the cutting edges 10, 11, 12 of the blades 7, 8, 9 and forwardly thereof. The support structure 40 is conveniently as that described in WO 97/37819, the contents of which are incorporated herein by reference, there being a pair of yoke arms 42 with free ends engaged in journal sockets 43 formed in the frame ends 5, 6 on the underside of the blade unit frame 2. The sockets 43 define stops 44 which are arranged to abut against the arms of the support structure 40 to define an end position limiting the range of pivotal movement of the blade unit 1 relative to the supporting structure 40 and handle 41. A return spring mechanism (not shown) is provided to bias the blade unit 1 into the end position. When shaving with the blades 7, 8, 9, the forces exerted thereon tend to pivot the blade unit 1 about the axis A away from the end position and against the spring bias whereby the blade unit 1 is able to follow the skin contours while performing a shaving stroke, in a manner known per se. By rotating the razor handle through 180° from the position in which it is normally held for shaving with the blades 7, 8, 9, those blades are moved out of position for shaving and the further blade 36 is brought into an operative shaving position, such as for shaving under the nose, or for trimming hair in front of the ears as shown in FIG. 4. When shaving with the further blade 36, due to the angle Φ between the tangential planes $t_1$ and $t_2$, the forces imposed against the blade unit 1 by the skin under the load applied by the razor user act to urge the stops 44 into firmer abutment with arms 42 of the support structure 40 effectively locking the blade unit 1 against pivotal movement about the axis A and enabling the user easily to position the blade accurately at the skin area to be shaved and to apply as much force as may be desired for shaving the area in question.

A second embodiment of a blade unit in accordance with the invention is illustrated in FIGS. 5 to 9. It differs from the blade unit described above only in construction of the sub-assembly of the frame element 30 and the auxiliary blade 36. Accordingly in FIGS. 5 to 9 the same reference numerals have been used to denote corresponding parts and components to those of the blade unit shown in FIGS. 1 to 4.

The auxiliary blade 36 in the blade unit of FIGS. 5 to 9 is fixedly attached to a metal blade support 50 which extends the full length of the blade 36, and the ends of the blade and blade support are embedded in the ends of the frame element 30 which can be plastic moulding directly moulded over the blade and blade support thereby forming a pre-assembled unit which is secured to the main frame 2 of the blade unit. The frame element has integral end extensions 51 which locate in corresponding recesses provided at the ends of the main frame in the areas where the blade retention clips 19 are fitted so that the clips 19 overlie the extensions 51 when they are wrapped around the ends of the blade unit to fix the frame element 30 securely to the main frame 2. The frame element includes a guard bar 52 defining the second guard surface 33, and a cap bar 53 defining the second cap surface 34, the cap and guard bars being parallel to each other and spaced apart over substantially the full length of the blade 36. The guard and cap bars 52, 53 are interconnected by two integral ribs 54 which lie in planes perpendicular to the length of the blade edge. These ribs 54 can serve two functions. Firstly they can impart greater rigidity to the guard bar 52, if it is needed, and secondly they can act as skin flow control elements to control the skin profile as the blade 36 is moved across it during shaving with this blade. In respect of the latter it may be noted that the upper edge surfaces 55 of the ribs 54 extend over the blade 36 and blade edge 37 between the second guard and cap surfaces 33, 34. Of course, more or less than two ribs could be provided if desired. The guard bar 52 is formed by a generally L-shaped member having a lip 56 which extends forwardly from the guard bar 52, in the direction opposite to the second guard surface 33, when the frame element 30 is mounted to the main frame 2 of the blade unit. The lip 56 forms the bottom edge of a slot 35 which opens at the bottom face of the blade unit and extends along the blade unit substantially the full length of the blade 36. Due to the open structure of the frame element 30 between the guard and cap bars 52, 53 there is created a passageway with relatively large through flow area connecting the gap between the second guard surface 33 and the blade edge 37 with the slot opening 38 at the lower face of the blade unit, this passage serving for through flow of rinsing water for removal of soap and shaving debris which collects within the frame element during shaving with the auxiliary blade 36. Since the shaving debris is cleared to the underside of the blade unit, risk of debris becoming deposited or settling on skin contacting components, especially the lubricating strip 28, at the upper face of the blade unit is minimised.

Modifications to the described embodiments are of course possible without departing from the principles of the invention. By way of example is mentioned that:

a) Two or more than three blades may be provided with cutting edges at the upper face of the blade unit;

b) More than one further blade with a cutting edge at the rear face can be provided;

c) The further blade or blades may be movably mounted in the blade unit, e.g. as the blades 7, 8, 9 are movably mounted in the described embodiment;

d) The second guard surface can be provided with an elastomeric strip and this strip could have upstanding fins or other projections for interaction with the skin and/or hairs; and e) The second cap surface may have a shaving aid strip for applying a shaving aid substance, such as a lubricant, to the skin surface, or the lubricating strip 28 at the first cap surface may be shaped and position so that it also contacts the skin when shaving with the auxiliary blade 36.

f) Instead of forming a pre-assembled unit, the auxiliary blade and blade support can be initially positioned on the main frame, and be retained on the main frame by a frame element subsequently fitted to the main frame, e.g. by a snap-fit connection.

It is to be understood, therefore, that the specifically described embodiment is given by way of non-limiting example only and it is intended that the invention should be limited only by the claims which follow.

The invention claimed is:

1. An integrated one-piece razor head comprising:

a razor head cartridge having a top surface, a bottom surface, a front surface, a back surface, and a primary blade group having a plurality of razor blades mounted in a primary blade platform and configured to provide broad area shaving in a first working plane at the front surface of the razor head cartridge, wherein the plurality of razor blades in the first blade group are angled at an acute angle with respect to the first working plane in a direction of broad area shaving;

a secondary blade group having at least one razor blade mounted in a secondary blade platform and configured to provide trim shaving in a second working plane, wherein the at least one razor blade in the second blade group is angled at an acute angle with respect to the second working plane in a direction of trim shaving;

wherein the secondary blade group is attached to the razor head cartridge at the top surface to create the integrated one-piece razor head wherein the primary blade group is separate from the secondary blade group and the secondary blade group is attached so that the first and second working planes intersect at an included angle between 10 degrees and 135 degrees.

2. The razor head of claim 1 wherein the secondary blade group attachment to the primary blade group is a bonded attachment.

3. The razor head of claim 1, wherein the primary blade group further comprises a primary cap and a primary guard.

4. The razor head of claim 3, wherein the secondary blade group further comprises a secondary cap and a secondary guard.

5. The razor head of claim 1, wherein the razor head cartridge defines a handle axis and the secondary blade group is attached so that the first and second working planes intersect each other so as to define a line of intersection that is substantially transverse to the handle axis.

6. The razor head of claim 5, wherein the plurality of razor blades of the primary blade group extend in a first direction and the at least one razor blade of the secondary blade group extends in a second direction substantially opposite to the first direction.

7. The razor head of claim 1, wherein the secondary blade group is attached to a top-back edge of the of the top surface of the razor cartridge.

* * * * *